US010865019B2

(12) United States Patent
Abrams et al.

(10) Patent No.: US 10,865,019 B2
(45) Date of Patent: Dec. 15, 2020

(54) CONTAINERS, CONTAINER INSERTS AND ASSOCIATED METHODS FOR MAKING CONTAINERS

(71) Applicant: CSP Technologies, Inc., Auburn, AL (US)

(72) Inventors: William Abrams, Auburn, AL (US); Kasey Myers, Auburn, AL (US); Ethan Ross Perdue, Auburn, AL (US)

(73) Assignee: CSP TECHNOLOGIES, INC., Auburn, AL (US)

( * ) Notice: Subject to any disclaimer, the term of this patent is extended or adjusted under 35 U.S.C. 154(b) by 88 days.

(21) Appl. No.: 16/334,105

(22) PCT Filed: Sep. 15, 2017

(86) PCT No.: PCT/US2017/051896

§ 371 (c)(1),
(2) Date: Mar. 18, 2019

(87) PCT Pub. No.: WO2018/053342

PCT Pub. Date: Mar. 22, 2018

(65) Prior Publication Data

US 2019/0367222 A1 Dec. 5, 2019

Related U.S. Application Data

(60) Provisional application No. 62/395,671, filed on Sep. 16, 2016.

(51) Int. Cl.

| | |
|---|---|
| ***B65D 43/16*** | (2006.01) |
| ***B01L 3/00*** | (2006.01) |
| ***B65D 47/08*** | (2006.01) |

(52) U.S. Cl.

CPC ..... *B65D 43/162* (2013.01); *B01L 3/50825* (2013.01); *B65D 47/08* (2013.01);
(Continued)

(58) Field of Classification Search

CPC ..... B65D 2543/00296; B65D 2543/00537; B65D 2209/00; B65D 2251/1058;
(Continued)

(56) References Cited

U.S. PATENT DOCUMENTS

| | | | |
|---|---|---|---|
| 4,426,014 | A | 1/1984 | Coltman, Jr. |
| 5,911,937 | A | 6/1999 | Hekal |

(Continued)

OTHER PUBLICATIONS

International Search Report dated Nov. 16, 2017 relating to PCT/US2017/051896.

*Primary Examiner* — Shawn M Braden
(74) *Attorney, Agent, or Firm* — Mark T. Vogelbacker; Eckert Seamans Cherin & Mellott, LLC

(57) ABSTRACT

A container (2) includes a container body (10) having a base (12), a sidewall (14), and a body extension portion (16), the body extension portion terminates at a body extension outer surface; a lid (40) connected to the container body and that is pivotable to move the container between a closed position and an open position, the lid comprising a cover portion (42) and a lid extension portion (44) extending therefrom and terminating at a lid extension outer surface, the lid extension portion having an underside. The body extension outer surface and the lid extension outer surface are generally co-planar when the container is in the closed position. The body extension portion hits n window (24) configured to provide access to the underside when the container is in the closed position to enable a user to apply upward pressure on the underside to move the container from the closed position to the open position.

18 Claims, 6 Drawing Sheets

(52) U.S. Cl.
CPC ..... *B65D 2543/00092* (2013.01); *B65D 2543/00101* (2013.01); *B65D 2543/00944* (2013.01)

(58) Field of Classification Search
CPC ..... B65D 2543/00101; B65D 2543/00351; B65D 43/22; B65D 2543/00842; B65D 2543/00685; B65D 2543/00731
USPC ..... 220/315
See application file for complete search history.

(56) References Cited

U.S. PATENT DOCUMENTS

| | | | | |
|---|---|---|---|---|
| 6,080,350 | A | 6/2000 | Hekal | |
| 6,124,006 | A | 9/2000 | Hekal | |
| 6,130,263 | A | 10/2000 | Hekal | |
| 6,174,952 | B1 | 1/2001 | Hekal et al. | |
| 6,214,255 | B1 | 4/2001 | Hekal | |
| 6,221,446 | B1 | 4/2001 | Hekal | |
| 2011/0127269 | A1 | 6/2011 | Bucholtz et al. | |
| 2014/0138384 | A1 | 5/2014 | O'Brien | |
| 2016/0001927 | A1 | 1/2016 | Lucas, Jr. et al. | |
| 2016/0023816 | A1* | 1/2016 | Giraud | B65D 43/16 220/263 |
| 2017/0112181 | A1* | 4/2017 | Belfance | B65B 5/04 |
| 2018/0057226 | A1* | 3/2018 | Austin | B65D 43/0208 |
| 2018/0273258 | A1* | 9/2018 | Luburic | B65D 55/06 |
| 2019/0062006 | A1* | 2/2019 | Breit | B65D 43/0233 |

* cited by examiner

CONTAINERS, CONTAINER INSERTS AND ASSOCIATED METHODS FOR MAKING CONTAINERS

CROSS-REFERENCE TO RELATED APPLICATIONS

This application is a U.S. National Phase of International Application No. PCT/US2017/051896 filed Sep. 15, 2017, which claims priority to U.S. Provisional Patent Application No. 62/395,671 filed Sep. 16, 2016, which are incorporated herein by reference in their entireties.

FIELD OF THE DISCLOSED CONCEPT

The disclosed concept relates to containers such as, for example and without limitation, containers used to store pharmaceutical or diagnostic items. The disclosed concept also relates to container assemblies including containers and devices coupled to the containers.

BACKGROUND

Containers are commonly employed to store pharmaceutical or diagnostic items such as, for example, medication or test strips. Flip-top containers, for example, typically include a container body that houses the pharmaceutical or diagnostic items, and a lid that is connected to the container body by a hinge. Such flip-top containers typically include a protuberance extending outwardly from a body of the lid. This protuberance, often referred to as a "thumb tab", facilitates opening of the container (e.g., a patient can grasp or otherwise apply upward force to the protuberance to allow the lid to open). However, this feature may pose a problem to users in that the protuberance could potentially get caught on objects, e.g., when carried in a purse or the like. This presents a risk that the container may be accidentally opened.

SUMMARY OF THE DISCLOSED CONCEPT

As one aspect of the disclosed concept, a container comprises a container body having a base, a sidewall extending therefrom, and a body extension portion extending from the sidewall, the body extension portion terminating at a body extension outer surface, the base and the sidewall defining an interior comprising a product space configured for housing at least one product, the body further having an opening leading to the interior. The container further comprises a lid that is connected to the container body by a hinge and that is pivotable about the hinge with respect to the container body to move the container between a closed position in which the lid covers the opening and an open position in which the opening is exposed, the lid comprising a cover portion configured to cover the opening when the container is in the closed position, the lid further comprising a lid extension portion extending from the cover portion and terminating at a lid extension outer surface, the lid extension portion having an underside configured for a user to apply upward pressure thereon when the container is in the closed position to move the container from the closed position to the open position. The body extension outer surface and the lid extension outer surface are generally co-planar with each other when the container is in the closed position. The body extension portion has a window configured to provide access to the underside of the lid extension portion when the container is in the closed position to enable a user to apply upward pressure on the underside of the lid extension portion to move the container from the closed position to the open position.

As another aspect of the disclosed concept, a container assembly comprises the aforementioned container, and a device coupled to the container. In one example embodiment, the device is a blood glucose meter or a cell phone case.

BRIEF DESCRIPTION OF THE DRAWINGS

Exemplary embodiments of the present disclosed concept are shown in the enclosed drawings as follows.

DETAILED DESCRIPTION OF THE PREFERRED EMBODIMENTS

As employed herein, the statement that two or more parts or components "engage" one another shall mean that the parts exert a force against one another either directly or through one or more intermediate parts or components. As employed herein, the term "number" shall mean one or an integer greater than one.

Figure 1:
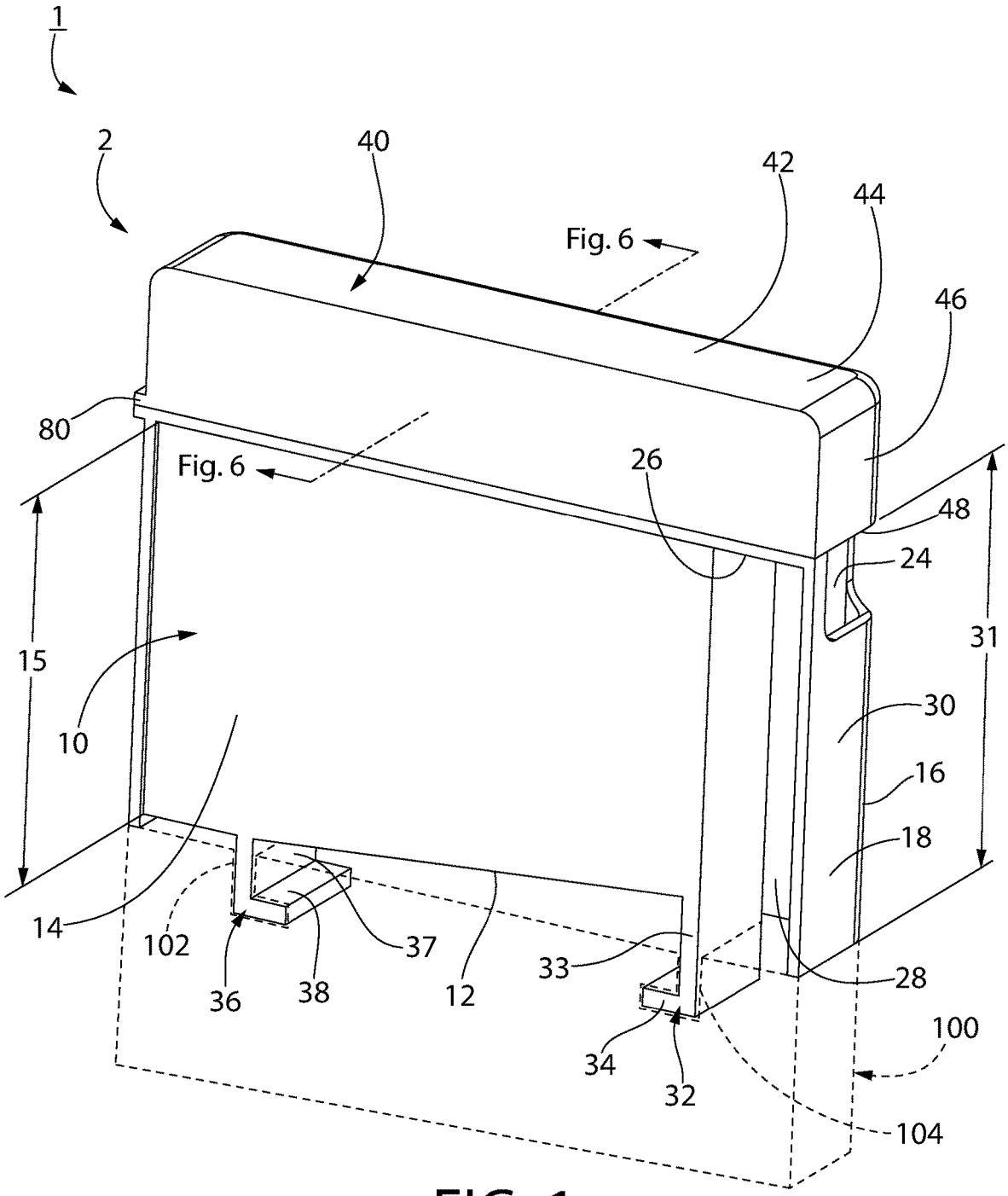
FIG. 1 is a front isometric view of a container assembly, shown with a container in the closed position, in accordance with one non-limiting embodiment of the disclosed concept.
Figure 2:
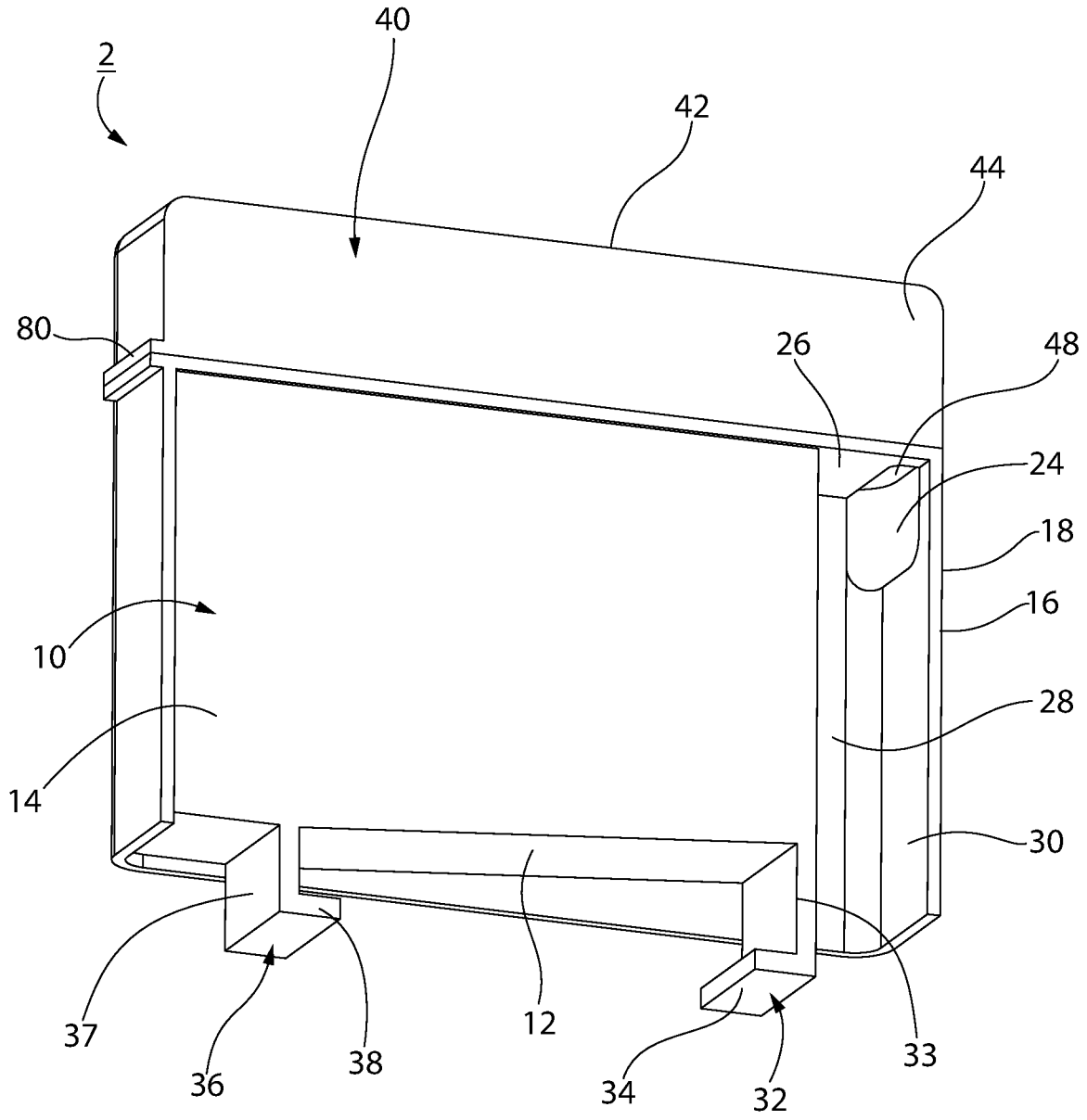
FIG. 2 is a front isometric view of the container of FIG. 1, shown in the closed position.
Figure 3:
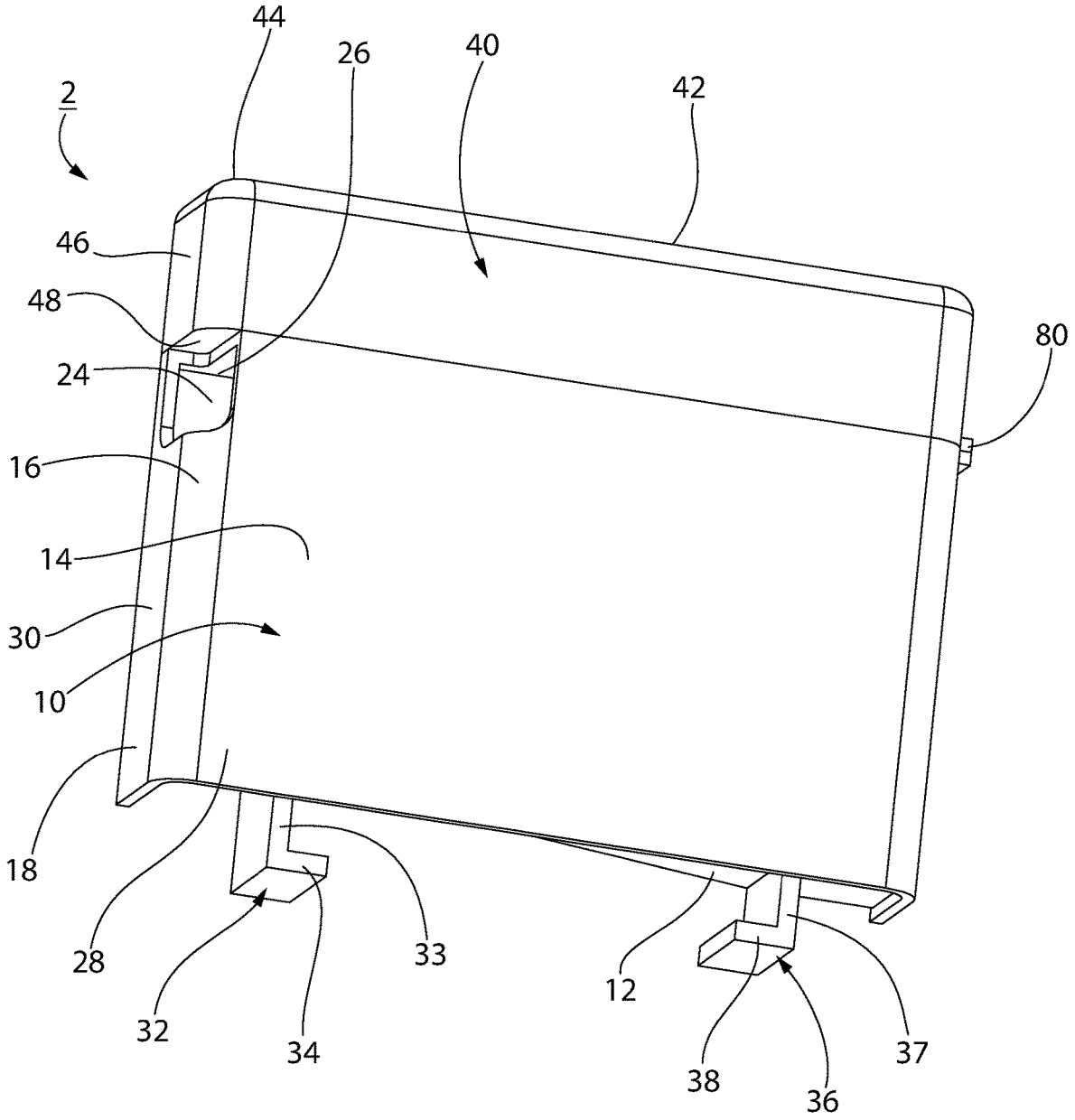
FIG. 3 is a rear isometric view of the container of FIG. 2, shown in the closed position.

FIG. 1 is a front isometric view of a container assembly 1, in accordance with one non-limiting embodiment of the disclosed concept. Container assembly 1 includes a container 2 and a device 100 (shown in simplified form in dashed line drawing) coupled to container 2. Container 2 may be used to store pharmaceutical or diagnostic items such as, for example and without limitation, medication or diagnostic test strips (e.g., for testing a patient's blood glucose levels). In one example embodiment, device 100 is a test strip meter adapted to read specimen samples provided on diagnostic test strips stored in container 2. In another example embodiment, device 100 is a cellular phone case adapted to be coupled to container 2. Container 2 includes a container body 10 and a lid 40 that is connected to container body 10 by a hinge 80. In one example embodiment, container 2 is a unitary component made from a single piece of material. As will be discussed in greater detail below, container 2 provides a novel mechanism to substantially minimize the likelihood that lid 40 will be inadvertently opened.

Figure 4:
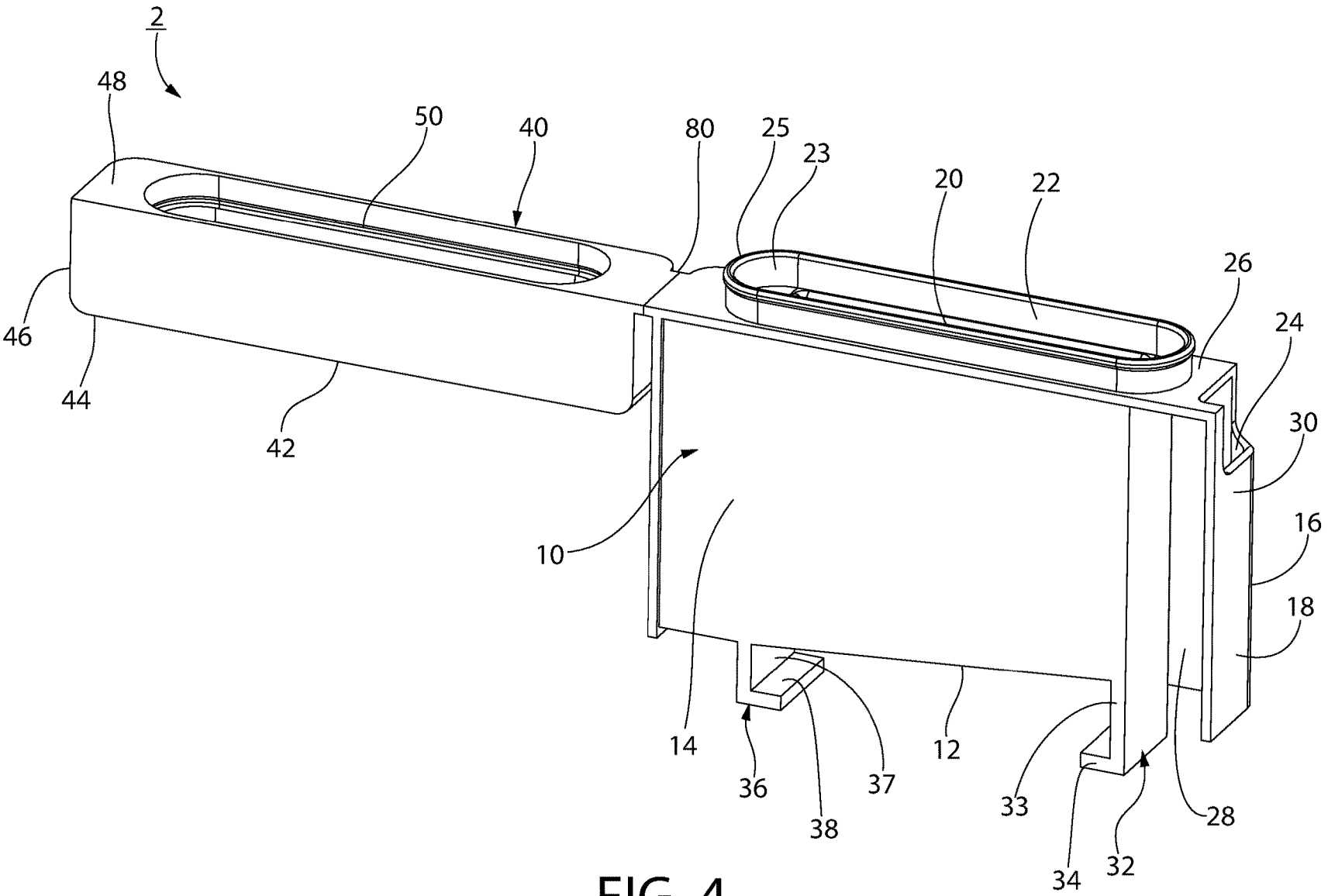
FIG. 4 is a front isometric view of the container of FIG. 3, shown in the open position.
Figure 5:
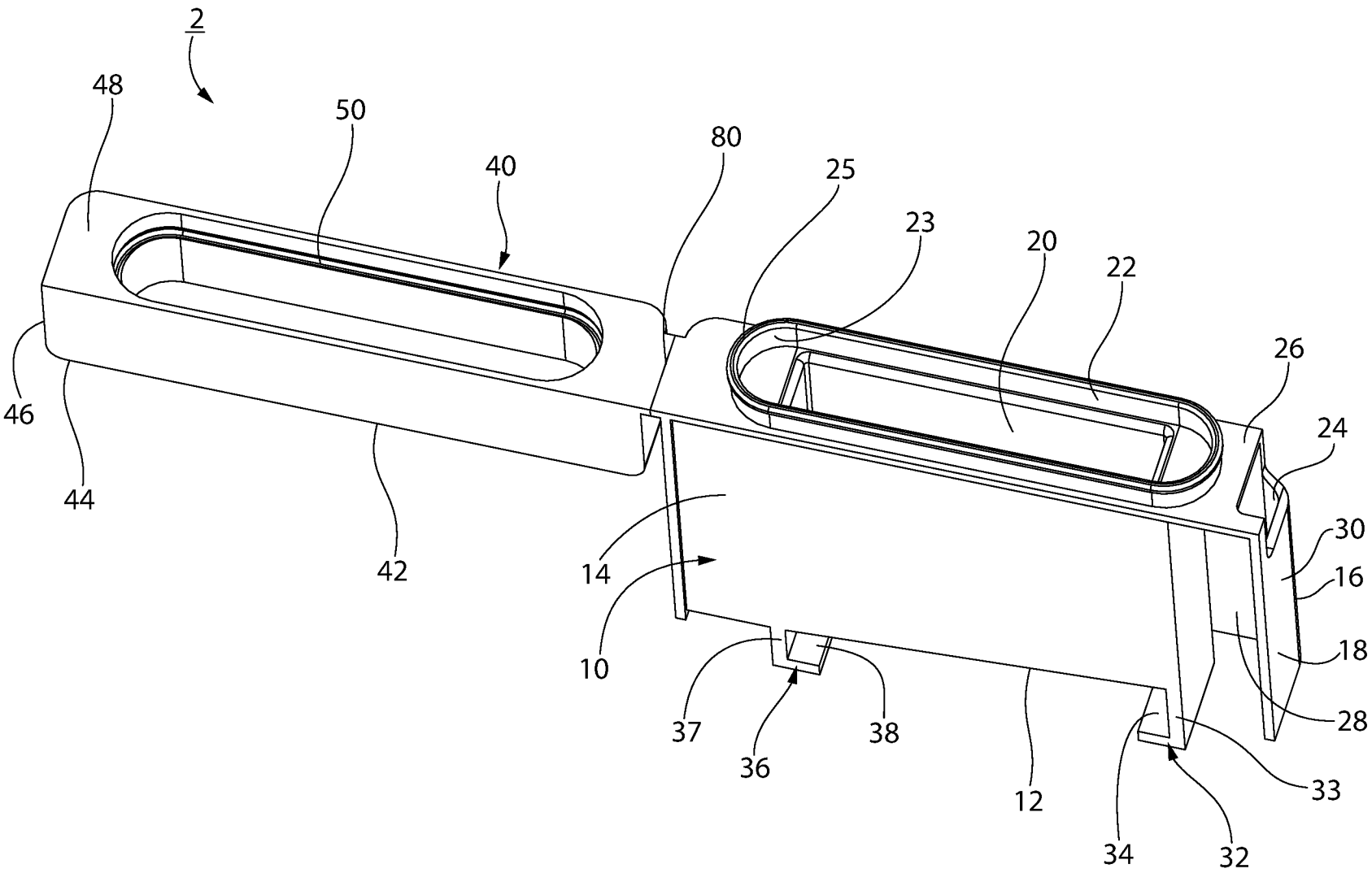
FIG. 5 is another front isometric view of the container of FIG. 4, shown in the open position.
Figure 6:
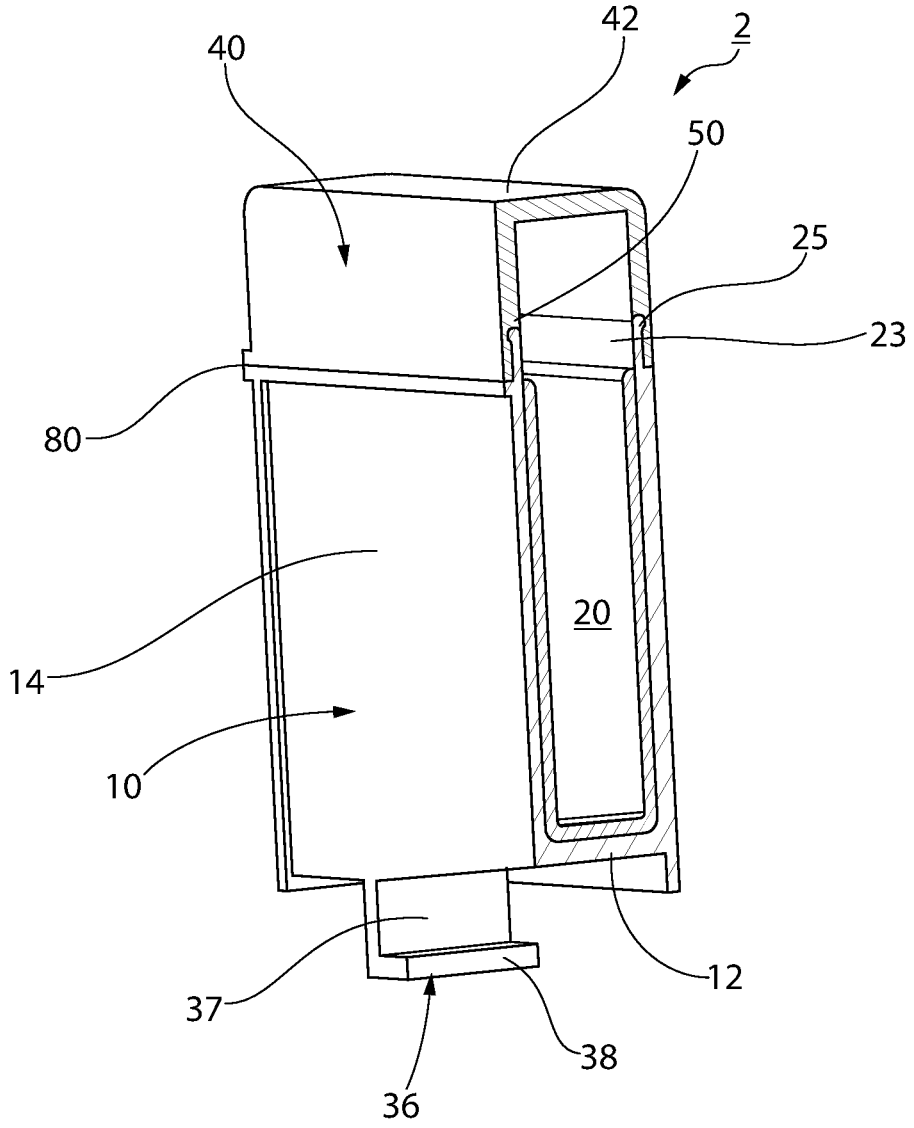
FIG. 6 is a section view of the container of FIG. 1.

FIGS. 1-3 and 6 show container 2 in a closed position, and FIGS. 4 and 5 show container 2 in an open position. Container body 10 has a base 12, a sidewall 14 extending from base 12, and a body extension portion 16 extending outwardly from sidewall 14. Sidewall 14 is generally disposed between body extension portion 16 and hinge 80. As shown in FIGS. 4 and 5, base 12 and sidewall 14 define an interior 20 that includes a product space configured to house at least one product, such as medication and/or test strips. Container body 10 further has an end portion 23 having a body sealing surface 25. Body sealing surface 25 has an opening 22 leading to interior 20. As shown in FIGS. 4 and 5, body sealing surface 25 is generally comprised of a partially rectangular-shaped middle portion, with partially circular-shaped end portions. It will, however, be appreciated that a suitable alternative body sealing surface (not shown) may have any known or suitable alternative shape (e.g., without limitation, elliptical-shaped), without departing from the scope of the disclosed concept.

Body extension portion 16 has a window 24 (i.e., a thru hole to provide access therethrough) and a number of wall portions 26, 28, 30. Wall portions 26, 28 each extend from sidewall 14, and wall portion 26 is perpendicular to sidewall 14 and wall portion 28. As shown in FIG. 1, wall portions 28, 30 each have a first length 31, and sidewall 14 has a second length 15 substantially the same as first length 31. It will be appreciated that when device 100 is coupled to container 2, having first and second lengths 31, 15 be substantially the same allows for a relatively smooth transition proximate the connection between wall portions 28,30 and device 100. Wall portion 30 extends from and is oriented generally perpendicular to wall portions 26,28. Wall portion 30 is spaced from sidewall 14, and has a body extension outer surface 18. Furthermore, as shown most clearly in FIGS. 4 and 5, window 24 preferably extends through each of wall portions 26, 28, 30. The function of window 24 will be discussed in greater detail below.

Lid 40 has a cover portion 42 and a lid extension portion 44 extending from cover portion 42. Cover portion 42 is generally disposed between lid extension portion 44 and hinge 80. Lid extension portion 44 terminates at a lid extension outer surface 46, and further has an underside 48 extending from and being located generally perpendicular to lid extension outer surface 46. In one example embodiment, when lid 40 covers opening 22, base 12 is not oriented parallel to cover portion 42. In this manner, test strips of different lengths are able to be housed within interior 20, and have their respective top portions be located at the same height, proximate the opening 22 that leads to interior 20. Alternatively, if the test strips are of uniform length, this configuration permits a selected test strip in an array to protrude at a height slightly higher or lower than an adjacent strip in the array, to help a user to more readily extract a single strip from the array. Moreover, as will be discussed below, underside 48 is configured for a user to apply upward pressure thereon when container 2 is in the closed position to move container 2 from the closed position to the open position.

In the closed position, cover portion 42 of lid 40 creates a moisture tight seal with container body 10. More specifically, cover portion 42 has a lid sealing surface 50 shaped substantially the same as body sealing surface 25. The moisture tight seal is formed by engaging lid sealing surface 50 with body sealing surface 25 (see, for example, FIG. 6). Such sealing configuration may incorporate that disclosed in U.S. Pat. Pub. No. 20110127269 to Bucholtz et. al, which is incorporated by reference herein in its entirety. Optionally, the sealing configuration provides a snap-fit closure. Moisture tight is defined as "a container having a moisture ingress rate of less than 1000 micrograms per day, at 80% relative humidity and 22.2 degrees C." Moisture ingress may thus fall within one of several ranges. One such range is between 25 and 1000 micrograms per day. Another such range is 50-1000 micrograms per day. A further such range is 100-1000 micrograms per day.

Lid 40 is further pivotable about hinge 80 with respect to container body 10 to move container 2 between the closed position (FIGS. 1-3 and 6) in which lid 40 covers opening 22, and an open position in which opening 22 is exposed. When container 2 is in the closed position, cover portion 42 covers opening 22.

The function of body extension portion 16 and lid extension portion 44 will now be discussed in detail. As shown most clearly in FIG. 1, body extension outer surface 18 and lid extension outer surface 46 are each disposed opposite and distal hinge 80. Furthermore, extension outer surfaces 18,46 are generally co-planar with each other when container 2 is in the closed position. Additionally, window 24 provides access to underside 48 of lid extension portion 44 when container 2 is in the closed position. This enables a user to apply upward pressure to underside 48 of lid extension portion 44 to move container 2 from the closed position to the open position. In this manner, container 2 is advantageously relatively easy to open, and includes a novel mechanism to prevent inadvertent opening. More specifically, the co-planar alignment of body and lid extension outer surfaces 18,46 is distinct from the alignment of common prior art flip-top containers (not shown), which typically include protuberances (e.g., a thumb tab) to allow a user to grasp and open the lid. As can be appreciated with the disclosed concept, window 24 provides a mechanism by which a user generally must reach internally with respect to body extension portion 16 and lid extension portion 44 to open container 2. This, combined with the co-planar, flush, and/or smooth extension outer surfaces 18, 46, provides one mechanism to advantageously minimize the likelihood that container 2 will not be inadvertently opened. As a result, container 2 is still able to be easily opened, but can generally only be done so when a user purposefully reaches into window 24 to engage and lift underside 48 of lid extension portion 44. In essence, the unique configuration of the disclosed concept provides an inner thumb tab.

Referring again to FIG. 1, container body 10 further optionally has a number of legs 32,36 each extending from base 12 away from interior 20 (FIGS. 4 and 5). Legs 32,36 each may include a corresponding first wall 33,37 extending from base 12, and a corresponding second wall 34,38 extending from and being located generally perpendicular to the corresponding first wall 33,37. As shown, wall 34 extends from wall 33 toward wall 38, and wall 38 extends from wall 37 toward wall 34. Legs 32,36 provide one non-limiting mechanism by which container 2 is coupled to device 100. More specifically, as shown, device 100 has a number of slots 102,104, and legs 32,36 are each located in a corresponding one of slots 102,104 in order to couple container 2 to device 100. It will be appreciated that suitable alternative leg configurations are contemplated by the disclosed concept. It should be understood that the slots 102, 104 and legs 32,36 are one of various types of attachment mechanisms that may be used according to the disclosed concept. Regardless of the specific structural configuration of the attachment mechanisms respectively of the container and the device, the mechanisms could be configured to effectuate modular attachment of the container to the device.

Accordingly, it will be appreciated that the disclosed concept provides for an improved (e.g., without limitation, better protected against inadvertent opening and more sleek) container assembly 1 and container 2 therefor, in which body and lid extension outer surfaces 18,46 are generally co-planar with each other in order to minimize the likelihood that a user will inadvertently open a lid 40.

Optionally, an insert, e.g., in the form of a sleeve, may be provided within the interior 20 of the container body 10. Such inserts may comprise desiccant entrained polymer formulations including a base polymer (for structure), a desiccant and optionally a channeling agent. These types of inserts and methods of making and assembling the same are disclosed, e.g., in Applicant's U.S. Pat. Nos. 5,911,937, 6,214,255, 6,130,263, 6,080,350, 6,174,952, 6,124,006 and 6,221,446, and U.S. Pat. Pub. No. 2011/0127269, all of which are incorporated by reference herein in their entireties.

The present disclosed concept has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The foregoing description of the specific embodiments will so fully reveal the general nature of the disclosed concept that others can, by applying knowledge within the skill of the art, readily modify and/or adapt for various applications such specific embodiments, without undue experimentation, without departing from the general concept of the present disclosed concept. Therefore, such adaptations and modifications are intended to be within the meaning and range of equivalents of the disclosed embodiments, based on the teaching and guidance presented herein, it is to be understood that the phraseology or terminology herein is for the purpose of description and not of limitation, such that the terminology or phraseology of the present specification is to be interpreted by the skilled artisan in light of the teachings and guidance.

The breadth and scope of the present disclosed concept should not be limited by any of the above-described exemplary embodiments, but should be defined only in accordance with the following claims and their equivalents.

What is claimed is:

1. A container comprising:

a container body having a base, a sidewall extending therefrom, and a body extension portion extending from the sidewall, the body extension portion terminating at a body extension outer surface, the base and the sidewall defining an interior comprising a product space configured for housing at least one product, the body further having an opening leading to the interior;

a lid that is connected to the container body by a hinge and that is pivotable about the hinge with respect to the container body to move the container between a closed position in which the lid covers the opening and an open position in which the opening is exposed, the lid comprising a cover portion configured to cover the opening when the container is in the closed position, the lid further comprising a lid extension portion extending from the cover portion and terminating at a lid extension outer surface, the lid extension portion having an underside configured for a user to apply upward pressure thereon when the container is in the closed position to move the container from the closed position to the open position;

wherein the body extension outer surface and the lid extension outer surface are generally co-planar with each other when the container is in the closed position, and wherein the body extension portion has a window configured to provide access to the underside of the lid extension portion when the container is in the closed position to enable a user to apply upward pressure on the underside of the lid extension portion to move the container from the closed position to the open position.

2. The container according to claim 1, wherein the body extension portion comprises a first wall portion, a second wall portion, and a third wall portion; wherein the first wall portion and the second wall portion each extend from the sidewall of the body; wherein the third wall portion extends from the first wall portion and the second wall portion and is spaced from the sidewall of the body; and wherein the window extends through the first wall portion, the second wall portion, and the third wall portion.

3. The container according to claim 2, wherein the first wall portion is disposed perpendicular to the sidewall and the second wall portion; wherein the third wall portion comprises the body extension outer surface; and wherein the third wall portion is disposed perpendicular to the first wall portion and the second wall portion.

4. The container according to claim 2, wherein the third wall portion has a first length; and wherein the sidewall has a second length substantially the same as the first length.

5. The container according to claim 1, wherein the container body further has a number of legs each extending from the base away from the interior.

6. The container according to claim 5, wherein each of the number of legs comprises a first wall and a second wall extending from and being disposed generally perpendicular to the first wall; and wherein the first wall extends from the base of the body.

7. The container according to claim 6, wherein the number of legs comprises a first leg and a second leg; wherein the second wall of the first leg extends from the first wall of the first leg toward the second wall of the second leg; and wherein the second wall of the second leg extends from the first wall of the second leg toward the second wall of the first leg.

8. The container according to claim 1, wherein in the closed position, the cover portion of the lid creates a moisture tight seal with the container body.

9. The container according to claim 8, wherein the moisture tight seal is formed by engaging a lid sealing surface with a body sealing surface.

10. The container according to claim 1, wherein the container is a unitary component made from a single piece of material.

11. The container according to claim 1, wherein the base is not disposed parallel to the cover portion when the lid covers the opening.

12. The container according to claim 1 comprising diagnostic test strips in the product space.

13. A container assembly comprising:

the container according to claim 1; and a device coupled to the container.

14. The container assembly according to claim 13, wherein the body further has a number of legs each extending from the base away from the interior; wherein the device has a number of slots; and wherein each of the number of legs is disposed in a corresponding one of the number of slots.

15. The container assembly according to claim 13, wherein the device is selected from the group consisting of a test strip meter and a cell phone case.

16. A method for making a container assembly, the method comprising:

a. providing a container according to claim 1, wherein the container comprises an attachment mechanism configured for modular attachment to a device;

b. providing a device, wherein the device comprises an attachment mechanism configured for modular attachment to the container; and c. utilizing the respective attachment mechanisms of the container and the device to effectuate modular attachment of the container to the device.

17. The method according to claim 16, wherein the device is a test strip meter.

18. The method according to claim 16, wherein the device is a cellular phone case.

* * * * *